US006032884A

United States Patent [19]

Bowling et al.

[11] Patent Number: 6,032,884

[45] Date of Patent: Mar. 7, 2000

[54] REPLACEABLE SHEAR EDGE FOR A STAR-TYPE FEEDER

[75] Inventors: Jonathon P. Bowling, Pell City; G. Blake Whiteside, Alexandria; James R Cheatham, Lincoln, all of Ala.

[73] Assignee: Ahlstrom Services Inc., Glens Falls, N.Y.

[21] Appl. No.: 09/031,065

[22] Filed: Feb. 26, 1998

[51] Int. Cl.[7] ..... B02C 19/12

[52] U.S. Cl. ..... 241/28; 241/224; 241/242

[58] Field of Search ..... 241/28, 280, 281, 241/282, 242, 243, 222, 224

[56] References Cited

U.S. PATENT DOCUMENTS

| | | | |
|---|---|---|---|
| 1,035,313 | 8/1912 | Buchanan . | |
| 2,068,450 | 1/1937 | Eberly . | |
| 2,681,091 | 6/1954 | Buboltz | 241/243 |
| 3,744,729 | 7/1973 | Ackerman . | |
| 3,779,123 | 12/1973 | Chafee | 241/243 |
| 4,000,860 | 1/1977 | Gotham . | |
| 4,015,782 | 4/1977 | Granite | 241/243 |
| 4,028,779 | 6/1977 | Shah . | |

OTHER PUBLICATIONS

"Continuous Digesters" by Brian Greenwood, Tech '91 Kraft Pulping Course, pp. 1.1, 2.4, 2.6; 1991.

*Primary Examiner*—Mark Rosenbaum
*Attorney, Agent, or Firm*—Nixon & Vanderhye P.C.

[57] ABSTRACT

In an otherwise conventional star feeder, equipment longevity is greatly enhanced by providing a readily replaceable shear edge at the downstreammost (in the direction of rotor rotation) portion of the feeder housing inlet, adjacent the clearance between the rotating pocketed rotor and the housing. Preferably one or more plates defining the shear edge are mounted by fasteners, such as screw threaded fasteners, to the housing. Where the feeder is retrofit, with the replaceable shear edge, a recess may be formed in the housing to accept and position the one or more shear plates. A shear plate may have a number of openings elongated in a dimension intersecting the clearance adjacent the inlet, and by loosening or tightening fasteners the position of the plate shear edge may be adjusted with respect to the clearance to provide an effectively new shear edge when it becomes worn. At least the shear edge portion of the shear plate may be of a hard wear resistant material, e.g. having a Brinnell Hardness at least 10% greater than that of the housing, and between about 350–450. A removable protective baffle is preferably disposed in the inlet in a position above and protecting the shear edge.

14 Claims, 5 Drawing Sheets

REPLACEABLE SHEAR EDGE FOR A STAR-TYPE FEEDER

BACKGROUND AND SUMMARY OF THE INVENTION

In the pulping industry, star-type rotary feeders are often used to convey material, for example, wood chips (or other types of comminuted cellulosic fibrous material), from one vessel to another, or from one set of process conditions to another. For example, such feeders are typically used to transfer chips from one pressurized state to another, typically, from a lower to a higher pressurized state. Conventional star-type feeders, for example, those sold by Ahlstrom Machinery of Glens Falls, N.Y. and serviced by Ahlstrom Services, of Pell City, Alabama, typically comprise pocketed rotors mounted for rotation within a cylindrical housing. The housing typically contains two or more openings or ports which accept chips under one set of process conditions, for example, pressure or temperature, and discharge chips under a different set of process conditions. The rotors typically comprise two or more pockets or cavities which communicate with the openings in the housing to accept chips introduced at one opening and are then transferred by rotation to the housing discharge opening. Typical star-type feeders include those sold under the names Airlock Feeder, Chip Meter, Low Pressure Feeder, or High Pressure Feeder, among other types of devices.

Since these star-type feeders are designed to transfer material from one set of process conditions to another, they are also designed to isolate the process conditions, that is, prevent leakage of liquids and gasses, between one state and another state. For this reason, the clearance between the outside diameter of the rotor and the inside diameter of the housing is typically tightly toleranced, and closely monitored and controlled to ensure that as little leakage as tolerable by the process occurs.

However, the material being transferred, for example, hardwood or softwood chips, in a dry, steamed or slurried state, makes it difficult to maintain the tight clearances without making some accommodation for the effect the rigid chips, or tramp material (such as stones, sand, nuts and bolts) can have upon the surfaces that define the clearance between the rotor and the housing. The surfaces of both the rotor and the housing, especially the leading edges exposed to the openings (especially the inlet) in the housing, can become worn or damaged during operation. This damage can increase the clearance between the running surfaces and result in increased leakage of process fluids. Damaged surfaces or debris can also increase the friction between the running surfaces and result in increased electrical loads on the motor or drive train turning the rotor.

Conventionally, the leading internal edge of the housing that confronts the material as it is transferred by the rotation of the rotor is critical to preventing the lodging of material between the inner surface of the stationary housing and the outer surface of the rotating rotor. This edge is typically designed and then monitored to minimize the possibility of material entering the clearance between the rotor and housing. The edge is typically given a sharp contour that acts to shear any outer material that is carried by the pocket of the rotor into the housing, and is commonly referred to as a "shear edge". The "shear edge" is typically a machined edge to ensure a sharp, clean contour. The feeder housing is typically cast, for example, cast in stainless steel, and this shear edge is machined at the same time the internal surface of the housing is machined to provide the desired clearance between the housing and the rotor. In order to further protect this shear edge, star-type feeders, for example, a Low Pressure Feeder, may also include a protective baffle positioned above the shear edge to prevent large particles from impacting and damaging the shear edge. This baffle, typically referred to as a "doctor blade" (though it does not act as a conventional doctor blade, for example, as used to doctor pulp from a rotating drum cylinder) is typically welded separately to the housing inlet.

Conventionally, star-type feeders have limited service life before the external surface of the rotor or the internal surface of the housing becomes sufficiently damaged that one or both surfaces need to be replaced, repaired, or "re-built". For example, at Ahlstrom Services, a "rebuild" typically comprises "overlaying" either damaged surface with weld material and then machining the overlaid weld material to the desired dimensions. Due to the exposure of the shear edge and its potential to be damaged during operation, the shear edge of the housing is typically more prone to damage. It is frequently damage to this shear edge, and sometimes this shear edge alone, that necessitates a rebuild of a feeder. For example, in one pulp mill the life of a Low Pressure feeder was limited to only 6 to 8 months due to excessive damage to its shear edge.

According to the invention it has been recognized that since the shear edge of a feeder is prone to such accidental damage, that providing a feeder with a shear edge that is readily replaceable can extend the service life of a feeder so that fewer rebuilds are necessary. In addition a more easily replaceable shear edge can provide less "down time" by the pulp mill in order to service the feeder.

According to one aspect of the invention a star-type feeder for transferring comminuted fibrous material is provided having as components: a housing, having at least one inlet opening for receiving material and at least one opening for discharging, and an internal shear edge adjacent the inlet; a rotor, rotatably mounted with the housing and having pockets for accepting material introduced to said housing; and a power source which rotates the rotor in said housing; and wherein the housing shear edge is readily replaceable.

According to one aspect of the present invention, a method of treating comminuted cellulosic fibrous material utilizing a star feeder having a rotor with a plurality of pockets rotatable within a cylindrical housing with an inlet and an outlet, a clearance between the housing and the rotor, and a shear edge in the inlet at a downstream portion of the inlet in the direction of rotation of the pocketed rotor is provided. The method comprises the steps of: (a) Feeding comminuted cellulosic fibrous material into the inlet. (b) Rotating the pocketed feeder to accept comminuted cellulosic fibrous material from the inlet and to carry the material past the shear edge to the outlet. (c) Discharging the comminuted cellulosic fibrous material from the pocketed rotor through the outlet. (d) When the shear edge is worn to approximately the point that excess leakage occurs or is substantially imminent, replacing the shear edge with a new shear edge while the practice of steps (a)–(c) is interrupted. And (e) repeating steps (a) through (d).

Where the shear edge is held in place by readily removable fasteners (such as screw threaded fasteners), step (d) may be practiced by removing the fasteners, removing the entire shear edge which was held on by the fasteners, replacing the shear edge, and holding the replaced shear edge in place with the fasteners. The shear edge may be provided by outer and inner shear plates which are attached by the fasteners in a stack, step (d) being further practiced by unfastening the fasteners, changing the positions of the outer shear plate and inner plate, and reattaching the fasteners. Where the fasteners are screw threaded and cooperate with internally threaded bores, step (d) is practiced by unscrewing the fasteners and then screwing the fasteners back into the threaded openings to reattach a new shear plate. Step (d) may also be practiced using a shear plate which has a shear edge with hardness properties of at least 10% (e.g. at least about 50%) greater than the hardness properties of the housing.

The method may be further practiced using a removable protective baffle mounted in the housing inlet in a position above the shear edge, providing protection for the shear edge. In that case there are the further steps of (f) readily removing the protective baffle prior to replacing the shear edge (e.g. by detaching and replacing the shear plate), and (g) after replacing the shear edge, reinstalling a protective baffle. The protective baffle may be held in place by screw threaded fasteners extending into and through the star feeder housing, in which case steps (f) and (g) are practiced by unscrewing the screw threaded fasteners holding the protective baffle in place, and re-screwing the fasteners back into place once the shear edge has been replaced; and positioning the protective baffle so that it engages at least one fastener for the shear plate.

Step (d) may alternatively be practiced by rotating the shear plate approximately 180° about a horizontal axis so as to provide a new shear edge, and reinstalling the same shear plate with a new shear edge. Step (c) may be practiced in part by utilizing a conventional steam purge, and then exhausting the steam from the pocketed rotor after the steam is purged, also conventional per se.

Where the shear edge is provided by a distinct shear plate adjustably mounted with respect to the housing so that the position of the shear edge with respect to the pocketed rotor can be adjusted, step (d) may be practiced by adjusting the position of the shear edge so that it is closer to the pocketed rotor. For example, where the shear plate is adjustably mounted to the housing by a plurality of screw threaded fasteners received by internally screw threaded openings in the housing, and passing through a plurality of slots in the shear plate, the slots elongated in a substantially radial dimension, step (d) may be practiced by loosening the screw threaded fasteners, adjusting the position of the shear plate by sliding the shear plate so that the elongated openings move with respect to the fasteners with the shear plate guided by the fasteners in the elongated openings, and tightening the fasteners.

The invention also relates to a method of refurbishing the star feeder in a pulp mill, the star feeder having a cylindrical housing with inlet and outlet, a pocketed rotor disposed within the housing and having a clearance with respect thereto, and rotatable about an axis within the housing, and a shear edge formed in the inlet at the portion thereof closest to the rotor at the most downstream portion of the inlet in the direction of rotation. The method comprises the steps of: (a) Stopping rotation of the pocketed rotor. (b) Cutting out the shear edge to form a recess in the housing. (c) Forming fastener receiving openings in the housing adjacent the recess. (d) Installing a shear plate in the recess, the shear plate having a shear edge, fastening the shear plate to the housing with fasteners extending into the fastener receiving openings so that the shear edge of the shear plate is adjacent where the original shear edge of the housing was, and so that it functions to minimize entry of material into the clearance between the rotor and the housing, and to shear any large material that attempts to enter the clearance. And (e) restarting operation of the star feeder.

Step (d) may be practiced by placing first and second plates, in a stack, in the recess. There may be the further step (f) of when the shear edge on the shear plate becomes worn, loosening the fasteners, replacing the shear edge (such as by sliding the plate substantially radially with respect to the clearance/rotor), and tightening the fasteners. The inlet may include a protecting baffle for protecting the shear edge from large particles and tramp material, and there may be the further steps of: (g) removing the protective baffle; (h) forming a plurality of openings in the housing past the inlet adjacent where the protective baffle is removed; and (i) fastening a replaceable protective baffle to the housing using fasteners passing into the openings formed in step (h).

According to yet another aspect of the invention, a star feeder is provided comprising the following components: a generally cylindrical housing having an interior and an inlet and outlet cooperating with the interior. A pocketed rotor mounted in the interior and rotatable in a direction of rotation with respect to the housing so that each pocket thereof, during rotation, moves from a position in communication with the inlet to a position in communication with the outlet, in a direction of rotation thereof; the rotor and housing interior having a clearance therebetween. A shear edge disposed adjacent the clearance in the downstreammost portion of the inlet, in the direction of rotation. And the shear edge mounted so that it is readily replaceable.

The shear edge may comprise an edge of a plate, and the plate may be mounted to the housing by a plurality of fasteners so that the plate is readily movable or replaceable. The plate may include a plurality of elongated openings therein extending in a dimension toward the clearance and the fasteners engaged in the elongated openings, and upon loosening of the fasteners the plate is movable with respect to the fasteners, the elongated openings sliding with respect to the fasteners, and upon tightening of the fasteners the plate is secured in place with respect to the housing with the shear edge thereof properly positioned with respect to the clearance. A readily replaceable protective baffle may be disposed above the shear edge to protect the shear edge from large particles and tramp material, and the protective baffle may comprise a mounting portion having a plurality of through extending openings therein. The housing has a plurality of through extending openings cooperating with the openings in the protective baffle mounting portion, and the assembly may further comprise a plurality of fasteners passing through the mounting portion opening and the housing opening to releasably hold the protective baffle to the housing.

It is the primary object of the present invention to provide a star feeder, and a method of treating comminuted cellulosic fibrous material utilizing a star feeder, which maximizes the time between rebuilds, by providing a readily replaceable shear edge. This and other objects of the invention will become clear from a detailed description of the invention and from the appended claims.

DETAILED DESCRIPTION OF THE DRAWINGS

Figure 1:
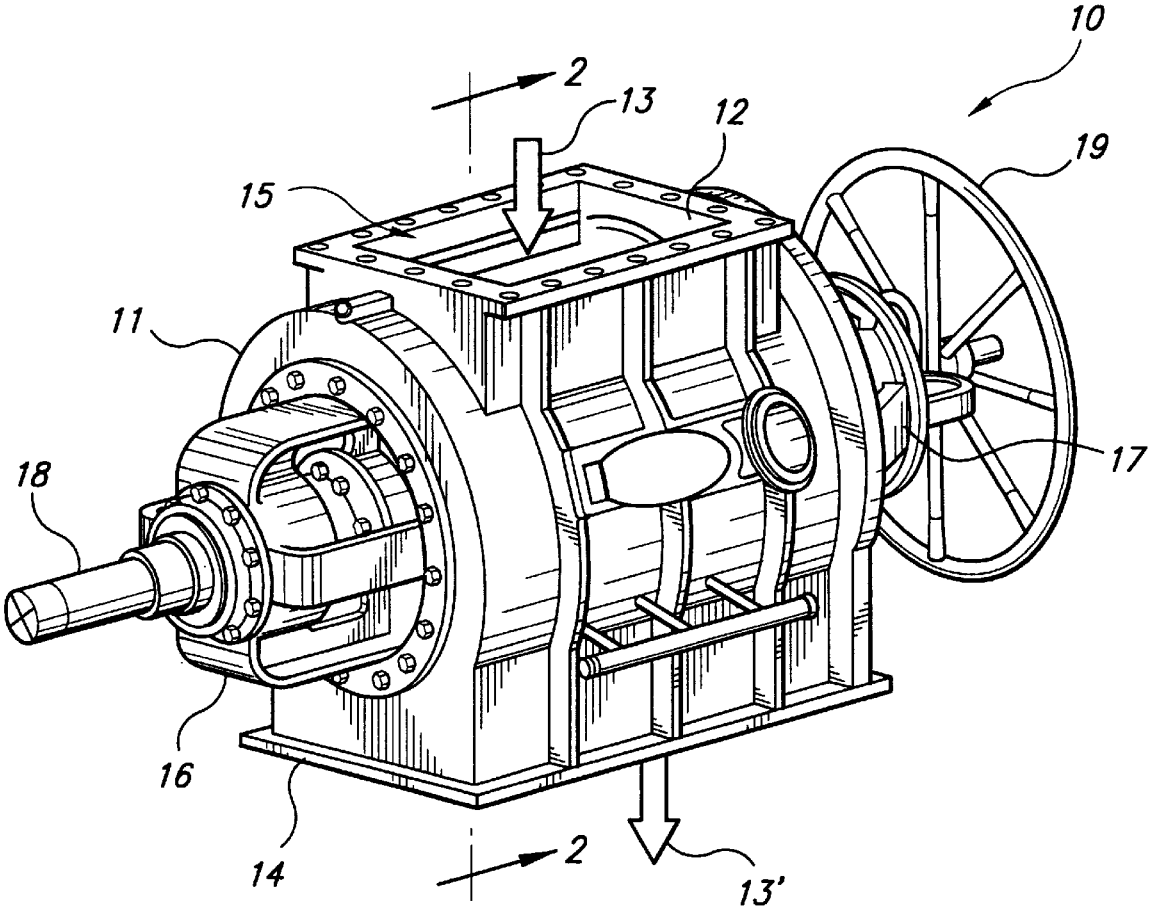
FIG. 1 is a top perspective view of one embodiment of an exemplary star feeder according to the present invention.

FIG. 1 illustrates an isometric view of one type of star-type feeder 10 according to the present invention, and with which a method according to the invention may be practiced. The feeder 10 shown is a Low Pressure Feeder marketed by Ahlstrom Machinery Inc. of Glens Falls, N.Y. and serviced by Ahlstrom Services of Pell City, Ala. It is to be understood that though the application of the present invention to a Low Pressure Feeder is used to illustrate the present invention, however the invention can be used for any type of star-type feeder that is used to convey comminuted cellulosic fibrous material. For the sake of illustration, the term "wood chips" or "chips" will be used throughout this discussion, though it is to be understood that any type of comminuted cellulosic fibrous material may be used in the practice of the invention, for example, hardwood, softwood, sawdust, straw, grasses, bagasse, etc.

Figure 2:
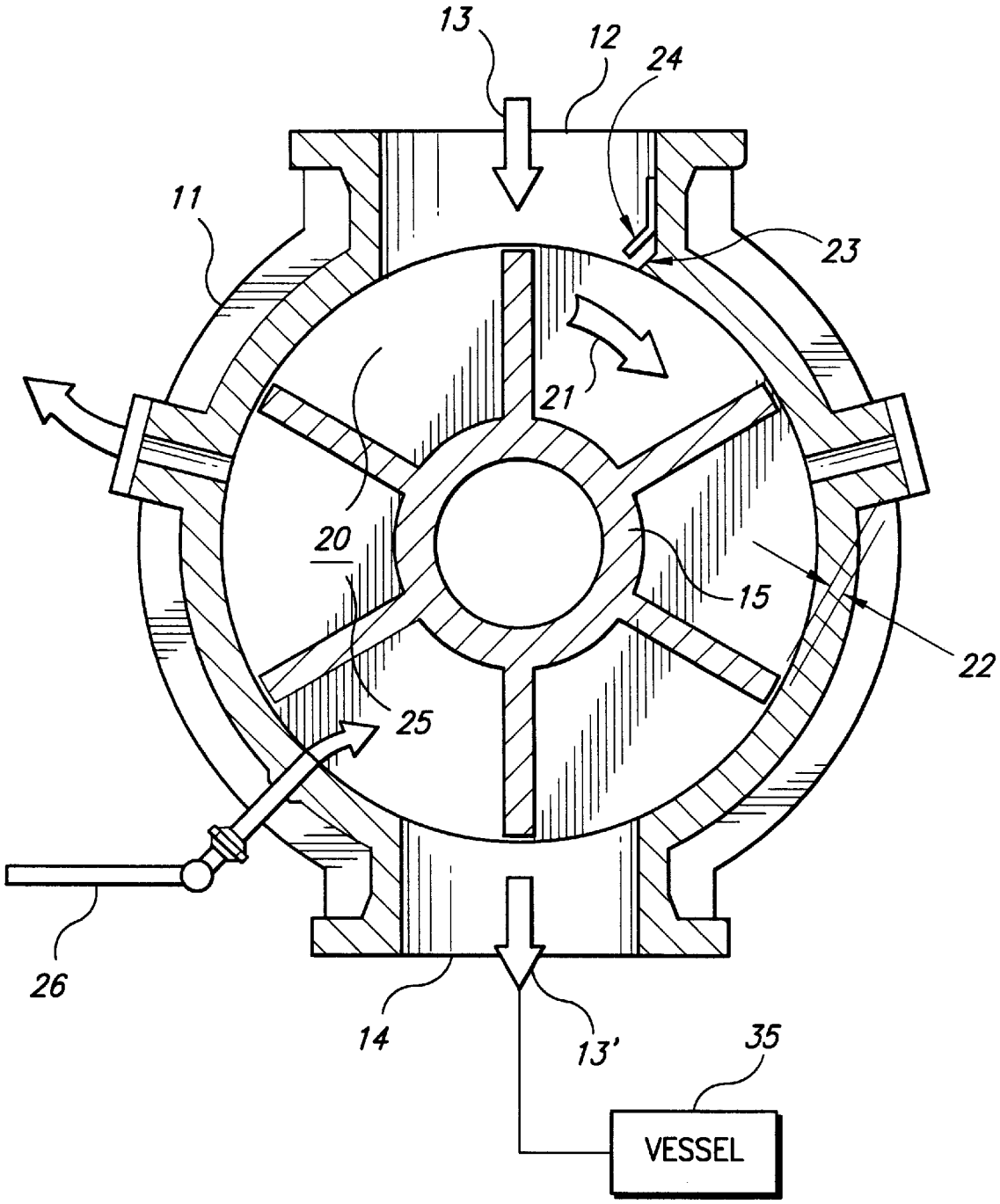
FIG. 2 is a schematic cross sectional view of FIG. 1 taken along lines 2—2 thereof.

The feeder 10 in FIG. 1 comprises or consists of a housing 11, having an inlet, 12, for chips, 13, an outlet, 14, and a rotor, 15 (not shown in FIG. 1, but seen in FIG. 2). The rotor 15 is rotatably supported in bearing housings 16, 17, and is driven by drive journal, 18 in turn powered by a power source, such as an electric motor. The rotor 15 and the internal diameter of the housing 11 are also typically complementarily tapered. That is, one end of the housing/rotor is smaller in diameter than the other end. This taper allows the rotor 15 to be axially moved in the housing 11 so that the radial clearance between the two can be adjusted, especially after some wear has occurred during operation. This axial adjustment is typically made by turning hand wheel 19 which rotates a threaded shaft which axially moves the rotor 15 in the housing 11 as desired.

FIG. 2 is a schematic cross sectional view of the feeder 10 taken through section line 2—2 in FIG. 1. The rotor 15 has pockets 20, which receive chips therein, and move the chips from the inlet 12 to the outlet 14. The rotor 15 turns in the direction of arrow 21. The radial clearance between the rotor outside diameter and housing inside diameter is shown at 22. The clearance 22 typically varies from 0.003" to 0.025". FIG. 2 also illustrates the typical prior art arrangement for preventing damage to the housing 11 and to prevent chips from lodging between the rotor 15 and housing 11. This includes a sharply profiled "shear edge", 23, and a deflection or protecting baffle ["doctor blade"] 24. As the pockets 20 fill with chips and then rotate in the direction of arrow 21, the shear edge, 23, "trims off" the top of the chip mass. The doctor blade, 24, acts as a deflector to prevent large chips or tramp material from impinging on the shear edge 23.

In operation, chips 13 fall into inlet 12, typically from a vessel above. This vessel may simply be a retention vessel, for example, a Chip Bin, or treatment vessel, such as a Diamondback® Steaming Vessel such as sold by Ahlstrom Machinery. There may also be a conveying or metering device immediately above inlet 12, such as a screw conveyor, plug-type feeder, or a Chip Meter, as sold by Ahlstrom Machinery. The prevailing pressure at the inlet 12 may vary from 0–1 bar (0–15 psi) gauge (or a slight vacuum may exist ). After entering the inlet 12, the chips fall into pockets 20. The chips may be deflected away from the shear edge 23 by doctor blade 24. While in pockets 20, the chips are transferred past shear edge 23 which limits the volume of chips transferred by trimming the top of the chip mass in the pocket. The chips are then transferred by the rotor 15 to the outlet 14 of the housing 11. The chips are discharged from the rotor 15 by gravity. This discharge may be assisted by a steam purge 25 introduced via conduit 26.

The chips 13' are typically discharged to a another vessel for retention or further treatment. The other vessel (connected to outlet 14 and shown schematically at 35 in FIG. 2) may be a conveying and treatment vessel, for example, a Steaming Vessel as sold by Ahlstrom Machinery, or it may be Chip Chute or Chip Tube also sold by Ahlstrom Machinery. This subsequent vessel may be unpressurized, but typically a pressure is maintained in the subsequent vessel, for example, a pressure of from about 0.5 to 3 bar (7 to 45 psi) gauge. The prevailing conditions in the outlet 14 of the feeder are isolated and prevented from leaking to the inlet 12 by the mass of chips 13 being conveyed, and by the close clearance 22 between the rotor 15 and the housing 11.

Figure 3C:
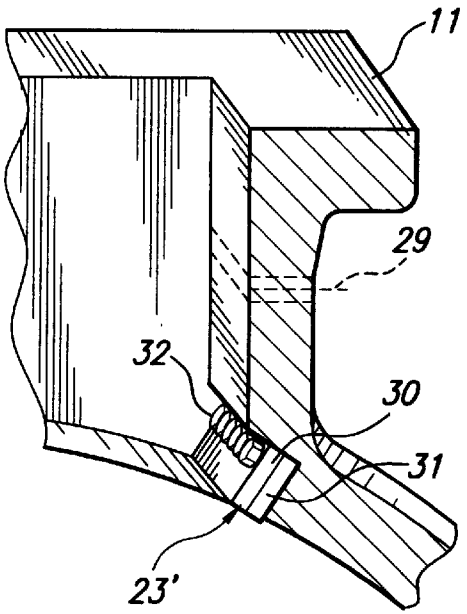
FIG. 3C is a view like that of FIGS. 3A and 3B only showing fasteners fastening the shear plates to the housing.
Figure 3B:
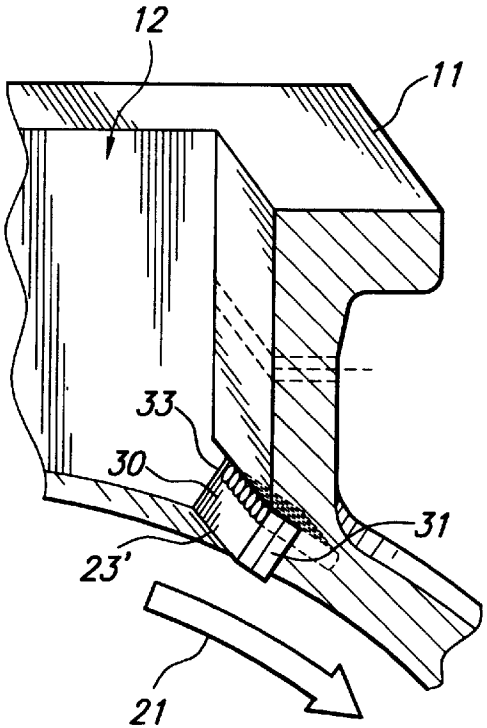
FIG. 3B is a view like that of FIG. 3A only showing two shear plates positioned in the recess.
Figure 3A:
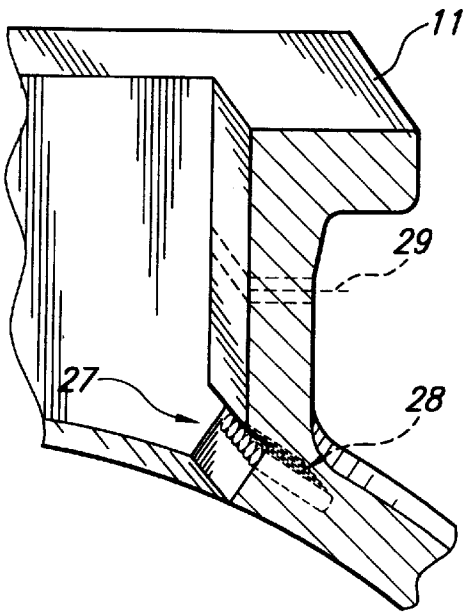
FIG. 3A is a perspective schematic detail view of the inlet of the star feeder of FIGS. 1 and 2, showing the recess adjacent where a shear plate is provided according to the invention.

FIGS. 3A, 3B and 3C illustrate one typical embodiment of a shear edge construction according to the present invention. These figures show an isometric view of the inlet 12 in the housing 11 in the vicinity of the shear edge 23 of FIG. 2.

As shown in FIG. 3A, the inlet 12 of housing 11 has been modified by machining a cut-out or recess 27 and introducing internally threaded holes 28 to the housing 11, e.g. by drilling and machining. Also shown in FIG. 3A are thru-holes 29 which can be provided for mounting a bolt-on doctor blade (24 in FIG. 2, 24' in FIGS. 4 and 5). FIG. 3B shows two plates 30,31 positioned in the recess 27 of FIG. 3A. The plates 30, 31 are preferably about ⅛" to 3" in thickness, typically, about ¼" to 1" in thickness, preferably, about ¼" to ½" in thickness, and include thru-holes 33 for attaching the plates 30, 31 to the housing 11. The plates 30, 31 mimic the geometry of the shear edge 23 in FIG. 2 but are replaceable should the edge 23 become damaged. FIG. 3C illustrates one method of retaining the replaceable plates to the housing. Though any suitable means may be used to secure the plates 30, 31, in this case, six evenly-spaced bolts 32 are used. The bolts 32 are typically 1 to 3 inches long, typically 1½ to 2 inches long, and the number of bolts may vary depending upon the geometry of the installation. Though the bolts 32 may be made from any appropriate material, they are preferably made from SAE A193-B8 or SAE J429 Grade 7 stainless steel or their equivalents. The potential for the bolts 32 to loosen during operation may be minimized by any conventional means, for example, by tack welding the bolts 32 to the plate 30 (and thereby the housing 11), or by using lock wire. The plate 30 defines a shear edge 23'.

Though FIGS. 3A through 3C illustrate a configuration in which one or more plates 30,31 are installed into a machined cut-out 27 in housing 11, it is also possible to install a replaceable plate without machining a cut-out 27 in the housing 11. For example, The replaceable plate (e.g. like plate 30) may be positioned on top of the shear edge of the existing housing (for example, on top of a worn shear edge 23 in FIG. 2) such that only threaded holes 28 need be machined into housing 11 to secure the one or more plates. Such a bolt-on plate protruding above the original shear edge may require that the doctor blade 24 or its installation be modified to accommodate the one or more plates. In addition, the cut-out or recess 27 may be formed in a separate plate or structure that can be secured to the housing 11, for example, by bolting or welding, and which can accept one or more replaceable plates 30, 31.

Though two plates 30, 31 are shown in FIGS. 3B and 3C, the replaceable shear edge may comprise or consist of one or more plates. However, it is preferable that at least two plates be used: an upper plate that provides the shear edge 23' and a lower plate 31 that acts as a spacer plate. In this configuration, as seen in FIGS. 3B and 3C, when the upper plate 30 is damaged, the assembly can be unbolted, and the position of the two plates 30, 31 reversed such that the undamaged former spacer plate 31 becomes the new shear edge 23' defining plate, and the damaged former shear edge plate becomes a spacer plate.

When two or more shear plates 30, 31 are used, it is preferred that the plates be installed in the housing 11 while the housing is being machined such that the internal radius of the replaceable plates 30, 31 will conform to the internal radius of the housing 11. In addition, during operation, adjacently mounted plates will experience the same relative degree of wear and the same degree of wear as the adjacent housing 11 such that when the upper plate shear edge is damaged beyond the point where it provides an effective shear edge, the lower shear plate that replaces it will have essentially the same amount of wear as the former upper plate and the same amount of wear as the housing 11 to which it is to be attached. Of course, if necessary, the replacement plate shear edge 23' can be machined to match the internal surface of the housing 11 if desired. Also, if desired, should the worn upper plate 30 be unusable as a spacing plate 31 below the replacement plate, a separate "spacer plate" 31 can be installed beneath the new shear-edge plate. If the bolt holes 28 are made deep enough, the spacer plate 31 may not be needed; i.e. the replacement plate 30 can be bolted directly to the housing 11 without a spacer plate.

Since the mode of operation of a feeder 10 and the conditions under which it is used will vary from mill to mill, in some feeders the clearance 22 between the rotor and housing might not be held close such that a relatively large clearance 22 is present between the housing 11 and rotor 15. In such situations, the wear of the shear edge 23' and housing may be minimal and only a single replaceable plate 30 is desired. For example, a plurality of single plates 30 can be machined to the geometry of the housing 11 during a rebuild and, since the geometry of the installed plate 30 and housing 11 may not wear much during operation, the additional plates can replace a worn plate while generally conforming to the geometry of the housing 11.

In another preferred embodiment, the one or more plates are made symmetric about their mounting holes 33, and the cavity into which they are placed, 27, is also made symmetric about the centerline of the threaded holes 28. In such a configuration a new shear edge can be provided by simply flipping a plate 30 over and re-installing it to provide a new shear edge 23'. Again, if necessary, the replacement edge 23' can be machined to match the housing 11 if desired. Also, the mounting holes 33 in plates 30, 31 may be slotted so that the position of the internal surface of the plates may be adjusted to match the internal surface of the housing (as described with respect to FIG. 6 below).

The housing 11 material is typically a castable material, for example, CaGNM stainless steel. The shear plates 30, 31 are typically made of a comparable material to the housing 11, for example, AISI 410 stainless steel, but also they can be made from a material specially designed to withstand the impacts that will occur in operation with little or no damage. For example, the plates may be made from materials such as stellite, or 440 stainless steel or their equivalents such that a more wear- and damage-resistant wear edge is provided. The plates 30, 31 may also be made of a material of comparable hardness to the housing 11 (for example, a Brinnell hardness of 230 to 260) to facilitate machining. Then after machining, the plates 30, 31 can be removed and treated in the as-machined condition to provide the desired strength or wear resistance. For example, the plates 30, 31 may be removed after machining and quenched and tempered to a desired hardness, for example, Brinnell Hardness of between about 350 and 450, typically between 380 and 400, which is at least 10% greater than the hardness of the housing 11. Preferable plate materials for such quench and tempering include AISI 410 or 440 stainless steel.

The surface of the plates, especially in the vicinity of the shear edge 23', may also be treated to harden the surface to minimize wear or damage. For example, the shear edge 23' of the replaceable plate 30 may be case hardened as is conventional, for example, by flame hardening, induction hardening or laser beam hardening. The shear edge 23' may also be surface treated by carburizing, nitriding, or related processes which harden the surface of the plate 30. Note that the present invention is ideally suited for such treatment because only the replaceable plates need be handled and treated instead of an entire housing 11.

Figure 4:
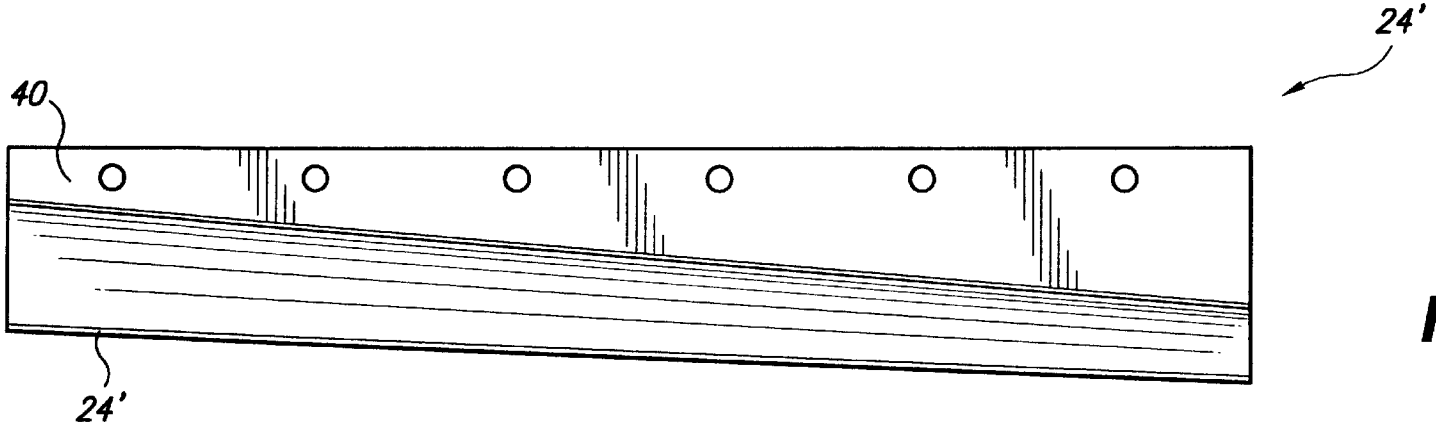
FIG. 4 is a front view of an exemplary protective baffle according to the invention.
Figure 5:
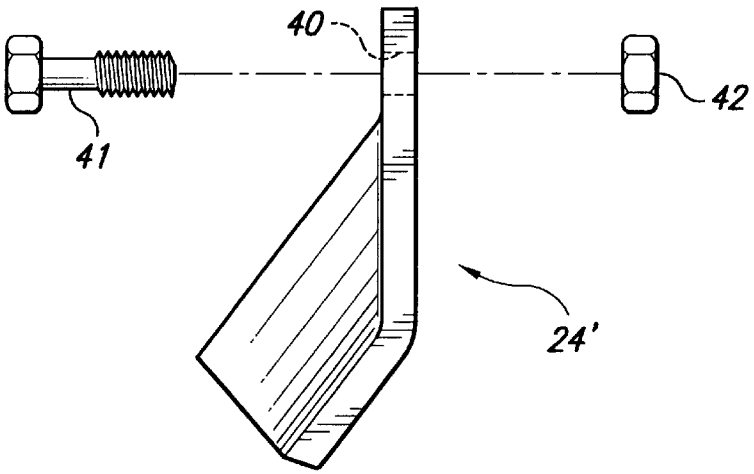
FIG. 5 is a side view of the baffle of FIG. 4, showing one of the fasteners used to hold it in place.

FIGS. 4 and 5 illustrate a typical replaceable doctor blade 24' that can be installed via bolts 41 into thru-holes 29 of FIG. 3A and secured by nuts 42. FIG. 5 is a side view of the protective baffle of FIG. 4, and showing a fastener associated therewith. The replaceable doctor blade 24' typically comprises or consists of a flat metal plate, for example, 5¼" in width, 29⅜" inches in length and ⅜" thickness having a plurality of through holes 40 evenly spaced along its length. The plate 24' is then bent, as best seen in FIG. 5, to an angle of approximately 40° so that, when installed, the blade promotes the movement of material from one end of the baffle 24' to the other to discourage stagnation of material and wear of the baffle 24' in any one location.

When installed, the baffle 24' may rest on the top of the mounting bolts 32 such that the bolts 32 support the baffle 32 against deflection while the baffle 24' shields the bolt heads 32 and shear edge 23' from damage. The baffle 32 may also prevent the bolts 32 from backing out of their threaded holes 28.

Figure 6:
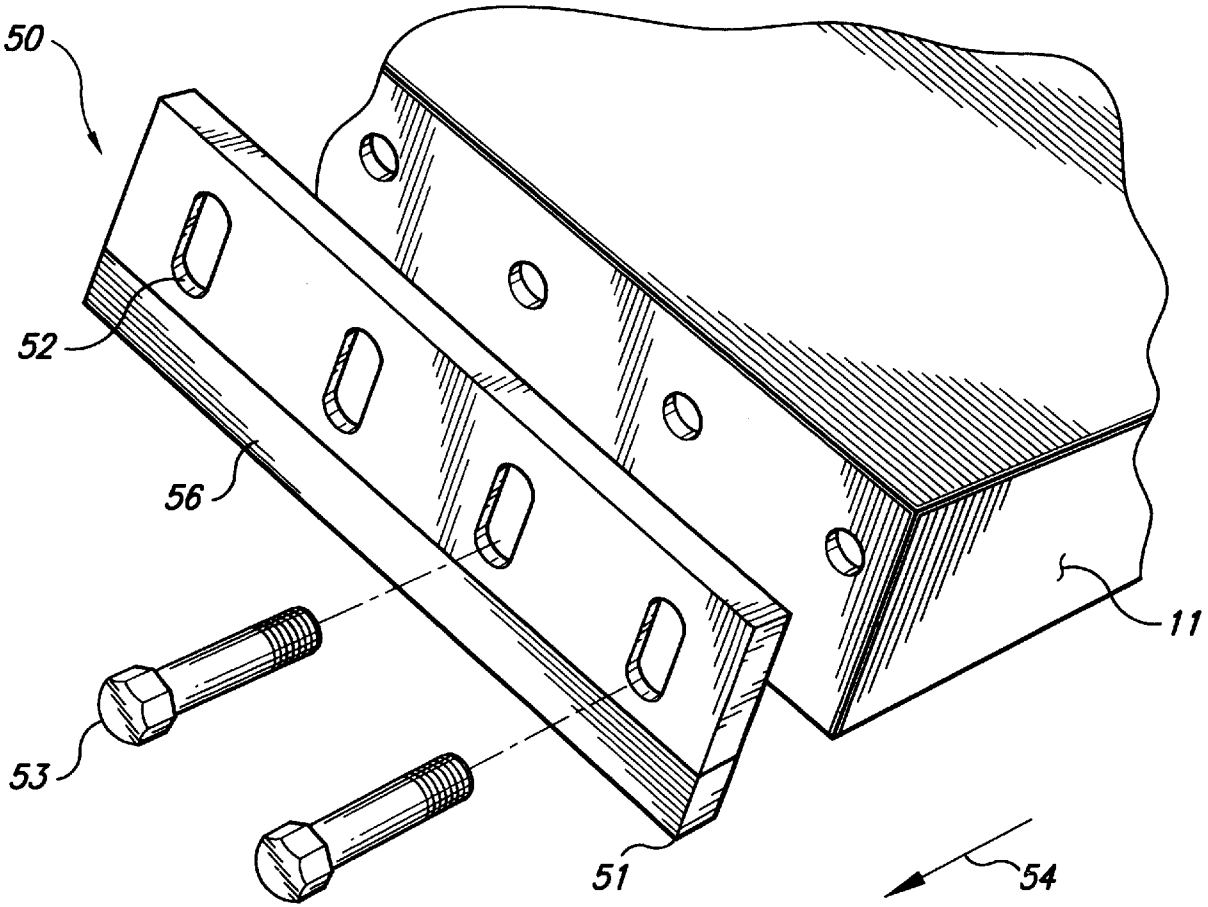
FIG. 6 is a schematic perspective detail view showing another embodiment of shear plate according to the present invention with associated housing inlet and fasteners.

Instead of completely replacing a plate to get a new shear edge, simply a new shear edge itself may be provided, as seen in FIG. 6. This is preferably accomplished by providing a plate 50 having a shear edge 51 with a plurality of elongated holes 52 therein, the holes 52 elongated in a dimension substantially perpendicular to the shear edge 51. The holes 52 receive bolts 53 which are tightened to clamp the plate 50 in place with respect to the housing 11 in a position to which the plate 50 has been adjusted to provide the shear edge 51 at the desired location with respect to the clearance 22. When the edge 51 becomes worn, the bolts 53 are loosened, the plate 50 is moved downwardly (in the direction 54 in FIG. 6) with the openings 52 sliding with respect to the fasteners 53 (which are still in place though loosened), and once the wear edge 51 has been established at an appropriate position with respect to the clearance 22, the fasteners 53 are tightened to properly secure the plate 50 in place.

FIG. 6 also shows the bottom portion (that containing the shear edge 51) of the plate 50 of, or coated with, a different material (shown schematically at 56) than the rest of the plate 50 that is harder than the rest of the plate 50 (e.g. at least 10% harder, preferably at least about 50% harder).

The equipment described above is used in a method of treating comminuted cellulosic fibrous material. The method comprises the following steps: (a) Feeding comminuted cellulosic fibrous material into the inlet 12. (b) Rotating the pocketed feeder 15 to accept comminuted cellulosic fibrous material from the inlet 12 and to carry the material past the shear edge 23' to the outlet 14. (c) Discharging the comminuted cellulosic fibrous material from the pocketed rotor 15 through the outlet 14. (d) When the shear edge 23, 23' is worn to approximately the point that excess leakage occurs or is substantially imminent replacing the shear edge 23, 23' with a new shear edge 23' while the star feeder 10 is shut down (i.e. the practice of steps (a)–(c) is interrupted). And (e) repeating steps (a) through (d).

The shear edge 10 may be held in place by readily removable fasteners 32; and then step (d) may be practiced by removing the fasteners 32, removing the entire shear edge 23' (e.g. by replacing plate 30) which was held on by the fasteners 32, and replacing the shear edge 23', and holding the replaced shear edge in place with the fasteners. The shear edge 23' may be provided by first and second shear plates (30, 31) which are attached by the fasteners in a stack; and then step (d) may be further practiced by unfastening the fasteners 32, changing the positions of the outer shear plate 30 and inner plate 31, and reconnecting the fasteners 32.

The fasteners 32 are preferably screw threaded fasteners which cooperate with internally threaded bores 28 in the star feeder housing 11; and wherein step (d) is practiced by unscrewing the fasteners 32 to remove the shear plate, and screwing the fasteners back into the threaded openings 28 to re-attach a new shear plate.

Step (b) may be practiced utilizing a shear plate edge 23' which has hardness properties at least 10% greater than the hardness properties of the housing 11. A removable protective baffle 24' may be mounted in the housing inlet 12 in a position above the shear edge 23, 23', providing protection for the shear edge; and then the method may comprise the further steps of (f) readily removing the protective baffle prior to replacing the shear edge 23' (e.g. detaching and replacing the shear plate 30), and (g) after replacing the shear edge 23', reinstalling the protective baffle 24'.

The invention also relates to a method of refurbishing a star feeder 10 in a pulp mill, the star feeder having a cylindrical housing 11 with an inlet 12 and outlet 14, a pocketed rotor 15 disposed within the housing and rotatable about an axis within the housing 11, and a shear edge 23, 23' formed in the inlet 12 at the portion thereof closest to the rotor at the most downstream portion of the inlet in the direction 21 of rotation; said method comprising the steps of: (a) Stopping rotation of the pocketed rotor 15. (b) Cutting out the shear edge 23 to form a recess 27 in the housing 11. (c) Forming fastener receiving openings 28 in the housing 11 adjacent the recess 27. (d) Installing a shear plate 30 (or 30 and 31) in the recess 27, the shear plate having a shear edge 23', fastening the shear plate 30 to the housing 11 with fasteners 32 so that the shear edge 23' of the shear plate 30 is adjacent where the original shear edge 23 of the housing 11 was, and so that it functions to minimize entry of material into the clearance 22 between the rotor and the housing, and to shear any large material that attempts to enter the clearance 22. And (e) restarting operation of the star feeder 10. Step (d) is preferably practiced by placing first and second plates 30, 31, in a stack, in the recess 27. There may also be the further step of (f) when the shear edge on the shear plate becomes worn, loosening the fasteners 32, 53, replacing the shear edge 23', 51 (e.g. by substantially radially moving plate 50 in the FIG. 6 embodiment), and tightening the fasteners 32, 53.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of treating comminuted cellulosic fibrous material utilizing a star feeder having a rotor with a plurality of pockets rotatable within a cylindrical housing with an inlet and an outlet, a clearance between the housing and the rotor, and a shear edge in the inlet at a downstream portion of the inlet in the direction of rotation of the pocketed rotor and wherein the shear edge is held in place by readily removable fasteners and further utilizing a removable protective baffle mounted in the housing inlet in a position above the shear edge, providing protection for the shear edge; said method comprising the steps of:

(a) feeding comminuted cellulosic fibrous material into the inlet;

(b) rotating the pocketed feeder to accept comminuted cellulosic fibrous material from the inlet and to carry the material past the shear edge to the outlet;

(c) discharging the comminuted cellulosic fibrous material from the pocketed rotor through the outlet;

(d) when the shear edge is worn to approximately the point that excess leakage occurs or is substantially imminent, replacing the shear edge with a new shear edge while the practice of steps (a)–(c) is interrupted by removing the fasteners, removing the entire shear edge which was held on by the fasteners, replacing the entire shear edge, and holding the replaced shear edge in place with the fasteners;

(e) repeating steps (a) through (c);

(f) readily removing the protective baffle prior to detaching and replacing the shear plate; and (g) after replacing the shear plate, reinstalling a protective baffle.

2. A method as recited in claim 1 wherein the shear edge is provided by outer and inner shear plates which are attached by the fasteners in a stack; and wherein step (d) is further practiced by unfastening the fasteners, changing the positions of the outer shear plate and inner plate, and reattaching the fasteners.

3. A method as recited in claim 2 wherein the fasteners are screw threaded fasteners which cooperate with internally threaded bores in the star feeder housing; and wherein step (d) is practiced by unscrewing the fasteners to remove the shear plate, and screwing the fasteners back into the threaded openings to re-attach a new shear plate.

4. A method as recited in claim 3 wherein step (d) is practiced utilizing a shear plate which has a shear edge with hardness properties at least 10% greater than the hardness properties of the housing.

5. A method as recited in claim 1 wherein the protective baffle is held in place by screw threaded fasteners extending into and through the star feeder housing; and wherein steps (f) and (g) are practiced by unscrewing the screw threaded fasteners holding the protective baffle in place, and re-screwing the fasteners back into place once the shear plate has been replaced; and positioning the protective baffle so that it engages at least one fastener for the shear plate.

6. A method as recited in claim 1 wherein step (d) is practiced by rotating the shear plate approximately 180° about a horizontal axis so as to provide a new shear edge; and reinstalling the same shear plate with a new shear edge.

7. The method as recited in claim 1 wherein step (c) is practiced in part by utilizing a steam purge, and then exhausting the steam from the pocketed rotor after the steam is purged.

8. A method as recited in claim 1 wherein the shear edge is provided by a distinct shear plate adjustably mounted with respect to the housing so that the position of the shear edge with respect to the pocketed rotor can be adjusted; and wherein step (d) is practiced by adjusting the position of the shear edge so that it is closer to the pocketed rotor.

9. A method as recited in claim 8 wherein the shear plate is adjustably mounted to the housing by a plurality of screw threaded fasteners received by internally screw threaded openings in the housing, and passing through a plurality of elongated slots in the shear plate, the slots elongated in a substantially radial dimension; and wherein step (d) is practiced by loosening the screw threaded fasteners, adjusting the position of the shear plate by sliding the shear plate so that the elongated openings move with respect to the fasteners with the shear plate guided by the fasteners in the elongated openings, and tightening the fasteners.

10. A star feeder assembly associated with a comminuted cellulosic material treatment vessel, comprising:

a star assembly comprising: a generally cylindrical housing having an interior and an inlet and outlet cooperating with the interior; a pocketed rotor mounted in said interior and rotatable in a direction of rotation with respect to said housing so that each pocket thereof, during rotation, moves from a position in communication with said inlet to a position in communication with said outlet, in a direction of rotation thereof; said rotor and housing interior having a clearance therebetween;

a shear edge disposed adjacent said clearance in the downstreammost portion of said inlet, in said direction of rotation; and said shear edge mounted so that it is readily replaceable;

a comminuted cellulosic fibrous material treatment vessel operatively connected to said outlet to receive comminuted cellulosic fibrous material from said outlet; and a readily replaceable protective baffle disposed above said shear edge to protect said shear edge from large particles and tramp material.

11. An assembly as recited in claim 10 wherein said shear edge comprises an edge of a plate; and wherein said plate is mounted to said housing by a plurality of fasteners so that said plate is readily movable or replaceable.

12. An assembly as recited in claim 11 wherein said plate includes a plurality of elongated openings therein extending in a dimension toward said clearance; and wherein said fasteners are disposed in said elongated openings and upon loosening of said fasteners said plate is movable with respect to said fasteners, said elongated openings sliding with respect to said fasteners; and upon tightening of said fasteners said plate is secured in place with respect to said housing with said shear edge thereof properly positioned with respect to said clearance.

13. An assembly as recited in claim 10 wherein said shear plate, at least at said shear edge thereof, is made of material having a Brinnell Hardness at least 10% greater than the hardness of said housing, and between about 350–450.

14. An assembly as recited in claim 10 wherein said protective baffle comprises a mounting portion having a plurality of through extending openings therein; and wherein said housing has a plurality of through extending openings cooperating with said openings in said protective baffle mounting portion; and further comprising a plurality of fasteners passing through said mounting portion opening and said housing opening to releasably hold said protective baffle to said housing.

* * * * *

US006032884C1

(12) EX PARTE REEXAMINATION CERTIFICATE (7391st)

United States Patent

Bowling et al.

(10) Number: US 6,032,884 C1

(45) Certificate Issued: Mar. 2, 2010

(54) REPLACEABLE SHEAR EDGE FOR A STAR-TYPE FEEDER

(75) Inventors: Jonathon P. Bowling, Pell City, AL (US); G. Blake Whiteside, Alexandria, AL (US); James R Cheatham, Lincoln, AL (US)

(73) Assignee: Andritz Inc., Glens Falls, NY (US)

Reexamination Request:
No. 90/010,458, Mar. 19, 2009

Reexamination Certificate for:

| | |
|---|---|
| Patent No.: | **6,032,884** |
| Issued: | **Mar. 7, 2000** |
| Appl. No.: | **09/031,065** |
| Filed: | **Feb. 26, 1998** |

(51) Int. Cl.
*B27L 11/00* (2006.01)

(52) U.S. Cl. ..... 241/28; 241/224; 241/242

(58) Field of Classification Search ..... None
See application file for complete search history.

(56) References Cited

U.S. PATENT DOCUMENTS

| | | | |
|---|---|---|---|
| 2,161,553 | A | 6/1939 | Westberg et al. |
| 2,474,862 | A | 7/1949 | Richter |
| 2,652,935 | A | 9/1953 | Messing |
| 2,858,212 | A | 10/1958 | Durant et al. |
| 2,933,208 | A | 4/1960 | Green |
| 3,137,918 | A | 6/1964 | Breuning |
| 3,171,693 | A | 3/1965 | Gillespie |
| 3,253,322 | A | 5/1966 | Christian |
| 4,201,501 | A | 5/1980 | Day |

*Primary Examiner*—Aaron J. Lewis

(57) ABSTRACT

In an otherwise conventional star feeder, equipment longevity is greatly enhanced by providing a readily replaceable shear edge at the downstreammost (in the direction of rotor rotation) portion of the feeder housing inlet, adjacent the clearance between the rotating pocketed rotor and the housing. Preferably one or more plates defining the shear edge are mounted by fasteners, such as screw threaded fasteners, to the housing. Where the feeder is retrofit, with the replaceable shear edge, a recess may be formed in the housing to accept and position the one or more shear plates. A shear plate may have a number of openings elongated in a dimension intersecting the clearance adjacent the inlet, and by loosening or tightening fasteners the position of the plate shear edge may be adjusted with respect to the clearance to provide an effectively new shear edge when it becomes worn. At least the shear edge portion of the shear plate may be of a hard wear resistant material, e.g. having a Brinnell Hardness at least 10% greater than that of the housing, and between about 350-450. A removable protective baffle is preferably disposed in the inlet in a position above and protecting the shear edge.

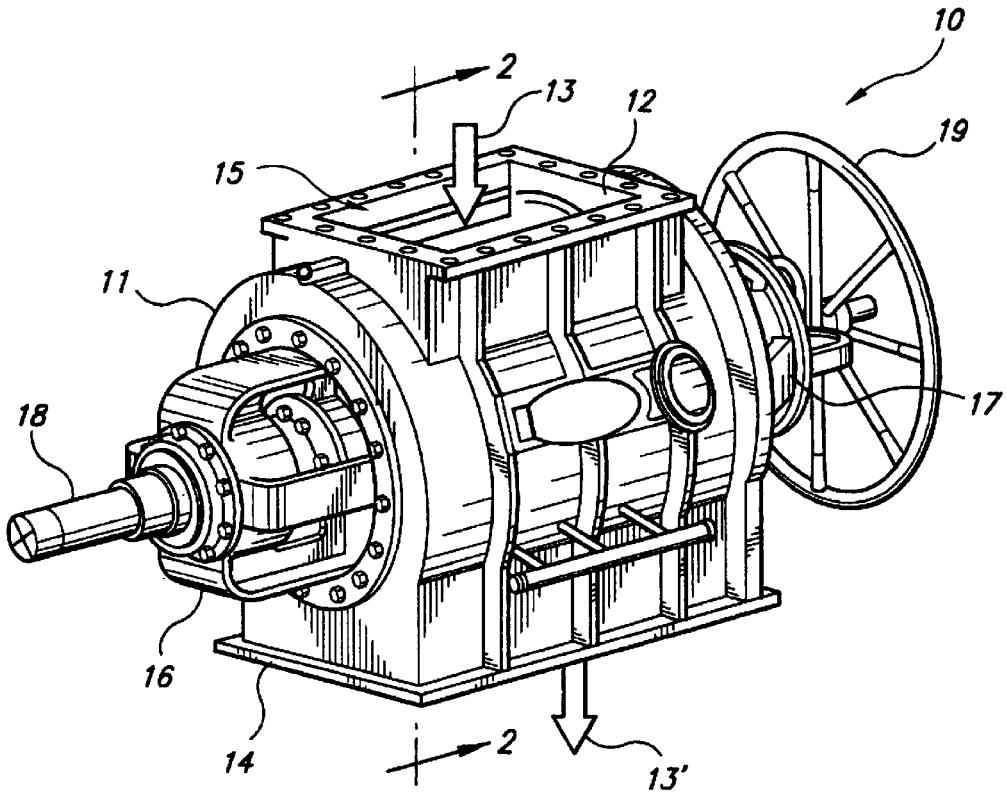

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–9 is confirmed.

Claims 11 and 12 are cancelled.

Claim 10 is determined to be patentable as amended.

Claims 13 and 14, dependent on an amended claim, are determined to be patentable.

10. A star feeder assembly associated with a comminuted cellulosic material treatment vessel, comprising:

a star assembly comprising: a generally cylindrical housing having an interior and an inlet and outlet cooperating with the interior; a pocketed rotor mounted in said interior and rotatable in a direction of rotation with respect to said housing so that each pocket thereof, during rotation, moves from a position in communication with said inlet to a position in communication with said outlet, in a direction of rotation thereof; said rotor and housing interior having a clearance therebetween; a shear edge disposed adjacent said clearance in the downstreammost portion of said inlet, in said direction of rotation; and said shear edge mounted so that it is readily replaceable;

a comminuted cellulosic fibrous material treatment vessel operatively connected to said outlet to receive comminuted cellulosic fibrous material from said outlet; and a readily replaceable protective baffle disposed above said shear edge to protect said shear edge from large particles and tramp material*;*

*wherein said shear edge comprises an edge of a plate;*

*wherein said plate is mounted to said housing by a plurality of fasteners so that said plate is readily movable or replaceable and said plate includes a plurality of elongated openings therein extending in a dimension toward said clearance; and*

*wherein fasteners are disposed in said elongated openings and upon loosening of said fasteners said plate is movable with respect to said fasteners, said elongated openings sliding with respect to said fasteners; and upon tightening of said fasteners said plate is secured in place with respect to said housing with said shear edge thereof properly positioned with respect to said clearance.*

* * * * *